US005384821A

United States Patent [19]

Jedlitschka et al.

[11] Patent Number: 5,384,821

[45] Date of Patent: Jan. 24, 1995

[54] RADIOGENIC UNIT

[75] Inventors: Hans Jedlitschka, Chatillon; Vincent Delacroix, Versailles, both of France

[73] Assignee: GE Medical Systems, Buc, France

[21] Appl. No.: 180,612

[22] Filed: Jan. 13, 1994

[30] Foreign Application Priority Data

Jan. 15, 1993 [FR] France ..... 93 00356

[51] Int. Cl.[6] ..... H05G 1/10

[52] U.S. Cl. ..... 378/199; 378/193; 378/202

[58] Field of Search ..... 378/199, 200, 202, 119, 378/127, 128, 130, 141, 142, 203, 193

[56] References Cited

U.S. PATENT DOCUMENTS

| | | | |
|---|---|---|---|
| 2,885,582 | 5/1959 | Bell . | |
| 2,909,664 | 10/1959 | Zunick et al. . | |
| 4,184,097 | 1/1980 | Auge | 378/140 |
| 4,694,480 | 9/1987 | Skillicorn | 378/119 |
| 4,920,554 | 4/1990 | Gabbay et al. | 378/202 |
| 4,995,065 | 2/1991 | Janouin et al. | 378/199 |
| 5,003,452 | 3/1991 | Sireul et al. | 363/61 |
| 5,060,253 | 10/1991 | Jedlitschka | 378/101 |
| 5,154,638 | 10/1992 | Sireul et al. | 439/611 |
| 5,197,604 | 3/1993 | Jedlitschka | 200/572 |
| 5,224,592 | 7/1993 | Jedlitschka | 200/572 |
| 5,257,304 | 10/1993 | Sireul et al. | 378/101 |

FOREIGN PATENT DOCUMENTS

| | | |
|---|---|---|
| 0381580 | 1/1989 | European Pat. Off. . |
| 0430755 | 11/1990 | European Pat. Off. . |

*Primary Examiner*—David P. Porta
*Assistant Examiner*—Don Wong
*Attorney, Agent, or Firm*—Nilles & Nilles

[57] ABSTRACT

A radiogenic unit comprising an X-ray tube with fixed anode made of copper and its circuit for high-voltage supply in single-pole mode, these elements being placed in two parts that are imperviously sealed against fixed against X-rays, secured to each other in a hermetically sealed way. The first part, made of an electrically insulating material, has cavities for the housing of the X-ray tube and its supply circuit. The second part, made of material with high thermal conductivity, comprises a cavity for the housing of the tube, the anode of which is connected to a thermal and electrical frame. It can be applied particularly to radiology instruments.

13 Claims, 6 Drawing Sheets

FIG. 5 a
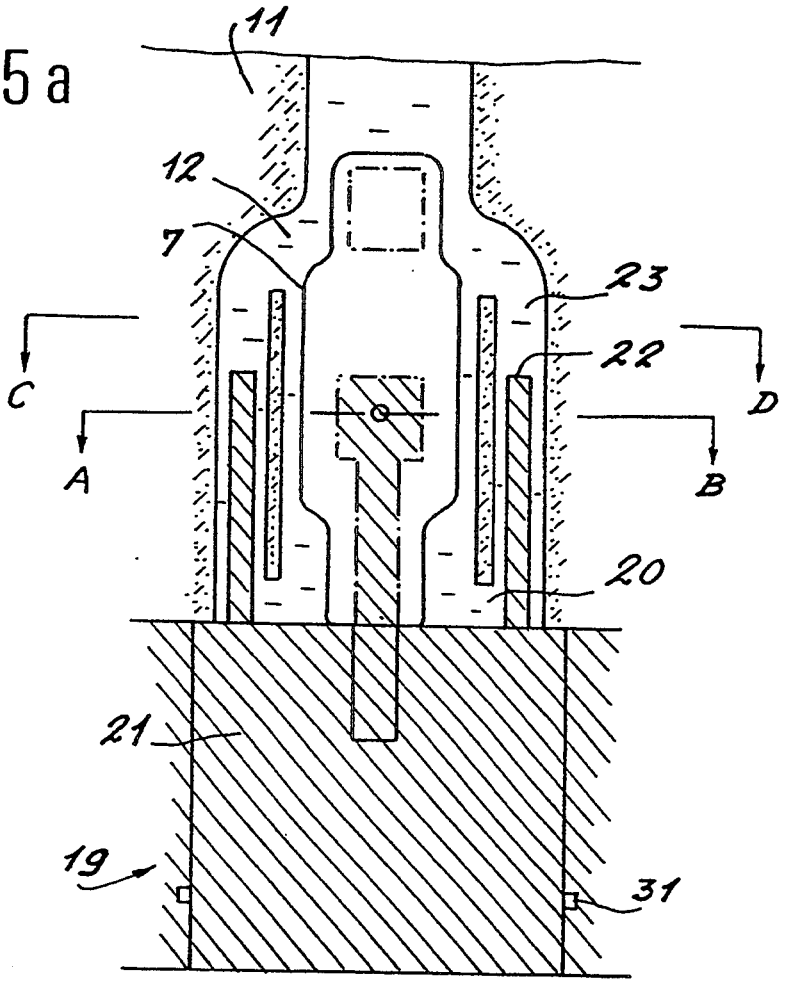
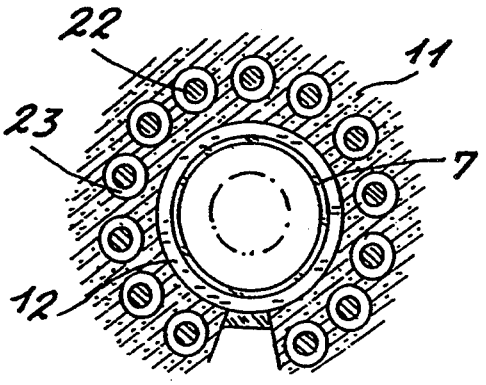
FIG. 5 b
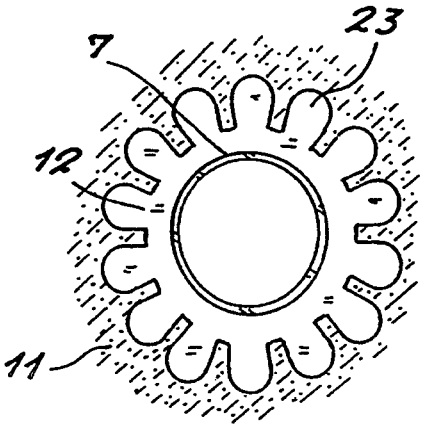
FIG. 5 c

RADIOGENIC UNIT

BACKGROUND OF THE INVENTION

1. Field of the Invention

The invention relates to a radiogenic unit and to its cooling system, enabling high power to be obtained while at the same time keeping the external casing of the apparatus cool.

Such a unit is used especially in radiology instruments.

2. Description of the Prior Art

At present, a radiogenic unit comprises an X-ray tube that is placed in a protective casing and is supplied with high voltage. The X-ray tube essentially comprises a cathode and an anode enclosed in a glass chamber under vacuum. The cathode is formed by a thermoelectronic emitter, such as a tungsten filament, that is housed in a metallic focussing element and that, when heated, emits an electron beam focussed on the anode. This anode is generally constituted by a massive disk of graphite covered with a layer of a material with a high atomic number emitting X-rays when it is bombarded by an electron beam. The anode is taken to a high positive potential (of several tens of kilovolts) with respect to the cathode, and the electrical field thus created between the two electrodes accelerates the electrons that are emitted by the cathode and that strike the anode on a small surface or zone of impact of said electron beam on the anode, which constitutes the focal spot of emission of the X-radiation. The high voltages that have to be applied to the electrodes are given by supply devices called high-voltage supply devices, such as the one described in U.S. Pat. No. 5,003,452 filed on behalf of the Applicant. A supply device such as this comprises inter alia a high voltage transformer connected to a voltage-doubling rectifier circuit and a heating transformer connected to the cathode.

Furthermore, the energy dissipated to produce the electron beam is converted partly into X-rays but above all into heat. This is why the X-ray tubes are positioned inside an insulating casing in which there flows a coolant fluid, generally electrically insulating oil. For a fixed anode tube, the heating of the anode is proportional to the mean power. Now, the anode on the one hand as well as the heating transformer on the other hand are electrically insulated, in bipolar mode, for a voltage equal to half of the maximum voltage. However, the cooling of the tube is limited by the fact that the two electrodes are insulated by oil whose thermal conductivity is relatively low, about three thousand times lower than that of copper. Owing the heating of the casing and the insulation oil inside, presently used radiogenic units work with limited mean power values.

The object of the present invention is to solve these problems by proposing a cooling of the anode that is speedier and more efficient, and an insulation of the voltage of the cathode with respect to the electrical ground or frame in a volume that is reduced as compared with prior art radiogenic instruments.

SUMMARY OF THE INVENTION

The invention concerns a radiogenic unit comprising an X-ray tube and its high voltage supply circuit wherein the X-ray tube, the copper anode of which does not rotate, is supplied in a single-pole mode, the cathode being carried to a very high negative potential and the anode being connected to the electrical ground or frame, and wherein the anode is also connected to the thermal frame of the unit.

According to another feature of the invention, the radiogenic unit furthermore comprises two parts imperviously sealed against fluids and X-rays that are hermetically secured to each other, the first part, made of an electrically insulating material, comprising a first open cavity in which there is housed the part of the X-ray tube containing the cathode, housing cavities for the elements of the high-voltage supply circuit, a housing cavity for the heating transformer of the cathode and channels for the circulation of the coolant fluid of the tube;

the second part, made of metal with high thermal conductivity, comprising an open cavity in which there is housed the part of the X-ray tube containing the anode and a cylinder supporting the tube, having the same conductivity as the anode that is electrically connected to said part which is itself connected to the electrical frame, said tube and said cylinder being detachable.

BRIEF DESCRIPTION OF THE DRAWINGS

Other features and advantages of the invention shall appear from the following description of a particular exemplary embodiment, said description being made with reference to the appended drawings, of which:

FIGS. 5*a*, 5*b*, 5*c* are partial views, in longitudinal section and cross-section, of a radiogenic unit according to the first embodiment of the invention, giving a detailed view of the circulation of coolant oil around the X-ray tube;

The elements bearing the same references in the different figures fulfil the same functions with a view to the same results.

MORE DETAILED DESCRIPTION

Figure 1:
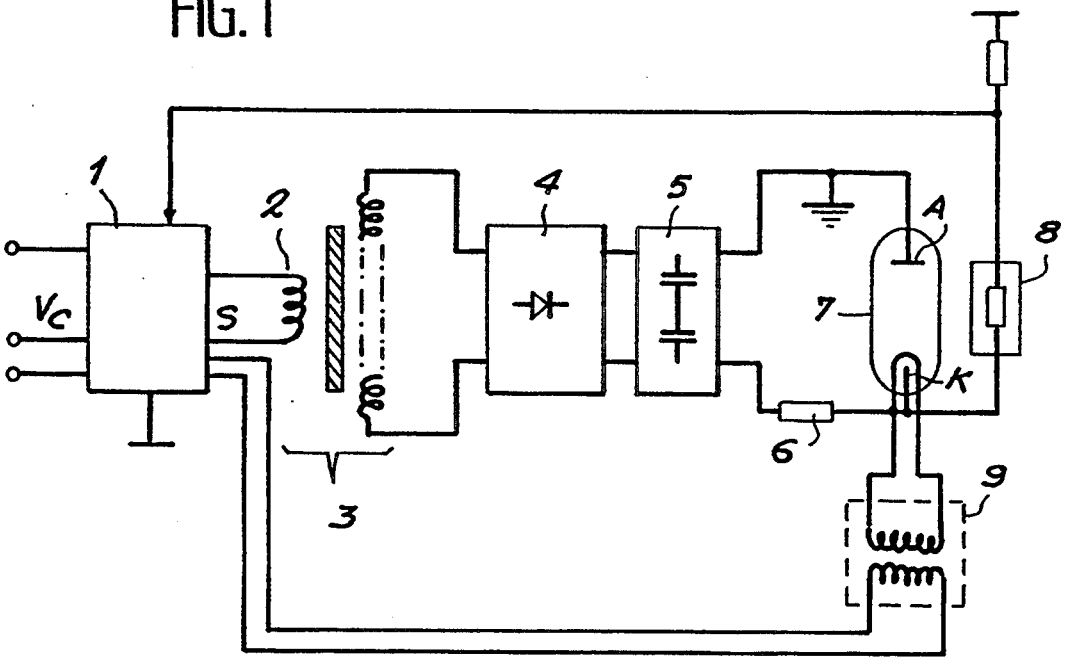
FIG. 1 is a general electrical diagram of the supply circuit of a radiogenic unit according to the invention.

FIG. 1 is the general electrical diagram of the supply circuit of a radiogenic unit according to the invention. A high-frequency converter 1 receives a DC voltage $V_c$ and delivers, at the output terminals, a high-frequency sinusoidal signal S which will feed the primary winding 2 of a high-voltage transformer 3. The output signal of the transformer 3 is sent into a high-voltage rectifier circuit 4 and then into a filtering circuit 5 formed by capacitors, before being directed to the cathode K of an X-ray tube 7 through a protection resistor 6, designed to limit the current in the event of a short-circuit in the X-ray tube. The anode A of the tube 7 is connected to the electrical frame. A high-frequency divider circuit 8 is set up between the cathode K of the tube 7 and the high-frequency converter circuit 1, with the aim of measuring the high-voltage potential of the cathode. The supply circuit furthermore comprises a heating transformer 9 that delivers a current flowing into the thermoemissive emitter of the cathode.

Figure 2:
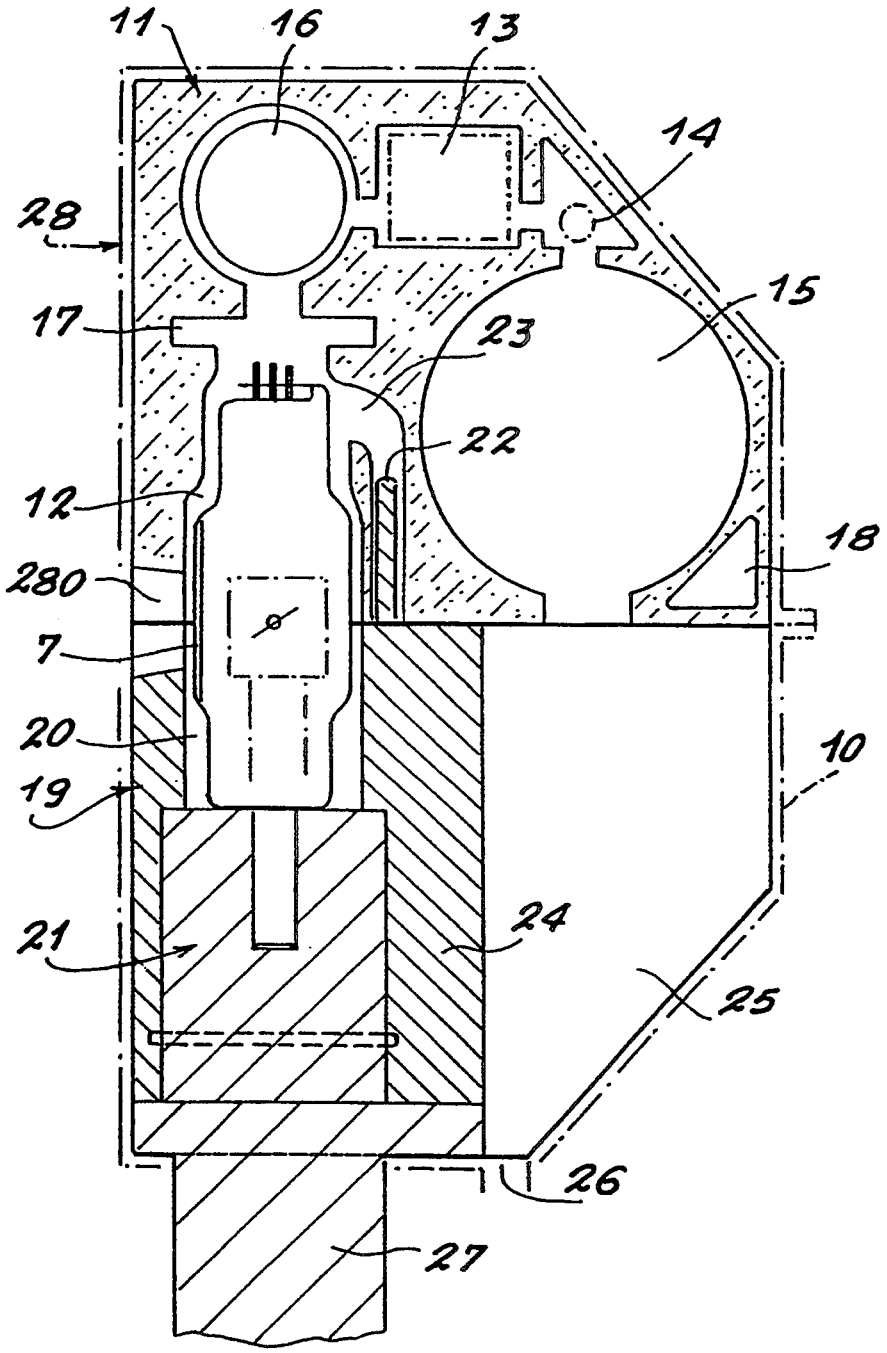
FIG. 2 is a longitudinal sectional view of a radiogenic unit according to a first embodiment of the invention.
Figure 3:
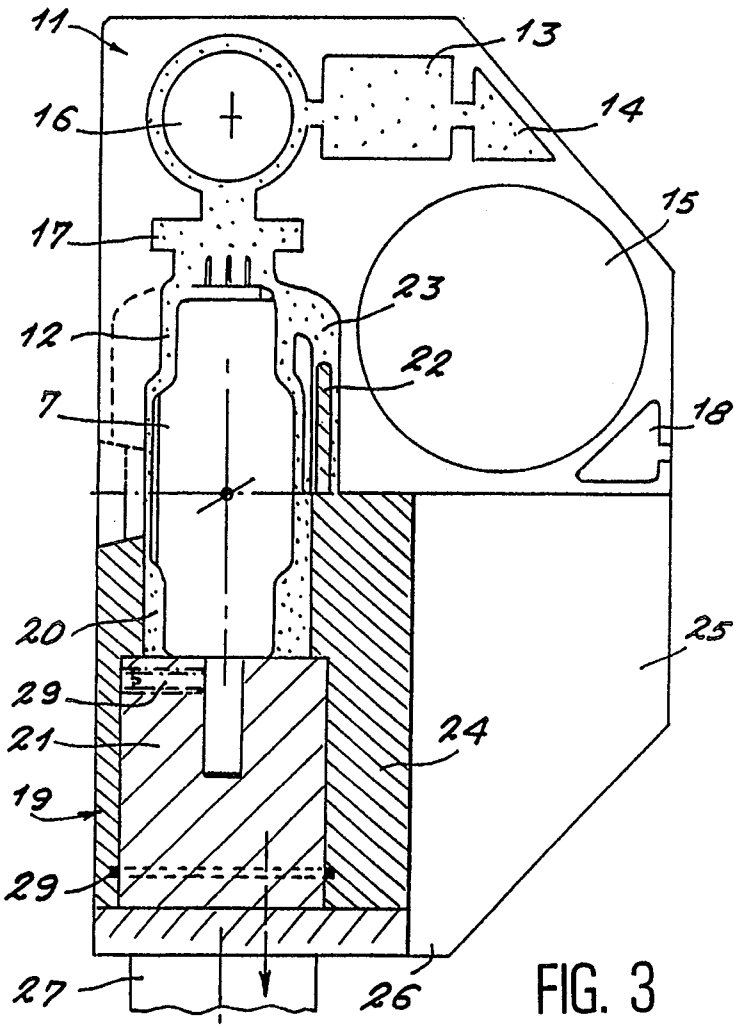

FIGS. 2 and 3 are longitudinal sectional views of two embodiments of the radiogenic unit according to the invention. This radiogenic unit 10 comprises an X-ray tube 7 and its high-voltage supply circuit as just described. The X-ray tube, the copper anode of which is stationary, is supplied in single-pole mode, the cathode being taken to a very high negative potential (of the order of 120 kilovolts), the anode being connected to the frame. The radiogenic unit according to the invention furthermore comprises two parts that are imperviously sealed against fluids and X-rays and are hermetically secured to each other.

In the embodiment shown in FIG. 2, the first part 11, made of an electrically insulating material such as dielectric plastic for example, has a first open cavity 12 housing the part of the X-ray tube that contains the cathode, cavities 13 to 15 for housing the elements of the high-voltage supply circuit, a cavity 16 to house the heating transformer of the cathode and channels 17 for the circulation of the tube coolant fluid such as insulating oil. For example, the cavity 13 houses the high-voltage measurement resistor, the cavity 14 houses the protection resistor and the cavity 15 houses the high-voltage transformer and the rectifier and filter circuits. It also has a cavity 18, called a compensation volume, wherein there is placed an expansion bag for the coolant fluid.

The second part 19, made of a metal with high thermal conductivity, has an open cavity 20 housing the part of the X-ray tube that contains the anode and a cylinder 21 supporting the tube, made of a material having the same conductivity as the anode, that is electrically connected to said part which is itself connected to the electrical frame, said tube 7 and said cylinder 21 being detachable to enable the tube to be changed. Said second part is provided with metal rods 22 that are positioned around the aperture of its cavity 20 and get inserted into holes 23 positioned around the first cavity 12 of the first part 11, wherein the coolant oil flows. These rods 22 ensure the cooling of the fluid by thermal conduction towards the second metal part.

The second part 19, which is made of a copper or aluminum for example, has a plain part 24 recessed with the housing cavity 20 for the X-ray tube 7 and a hollow part 25 in which there is housed a high-frequency converter 1. The low-voltage DC current arrives by an aperture 26 made in the hollow part 25 of the metal part 19.

In a radiography apparatus, the second part 19 is fixedly joined to the support 27 of the radiogenic unit and then works as a heat sink. Indeed, it enables the extraction of the heat by thermal conduction before natural convection or cooling by a fluid for example. Furthermore, its electrical potential is zero.

In the exemplary embodiment of FIG. 2, the two parts 11 and 19 are enclosed in a metal cover 18 that is imperviously sealed against fluids and X-rays, except at a window 280 permitting the passage of the X-radiation sent out by the anode, formed by two elements each covering one of the two parts.

FIG. 3 shows the flow of electrically insulating oil around the X-ray tube 7, in the cavity 12 and in the channels 17 of the insulating part 11 as well as in the part of the cavity 20 of the metal part 19 that surrounds the tube 7. The cylinder 21 supporting the X-ray tube comprises an O-ring seal 29 positioned at that end of its external surface which is closest to the tube 7, so as to limit the circulation of oil around the tube. Thus the oil heated by the tube is cooled by thermal conduction in the metal part 19 and then in the support 27 of the radiogenic unit 10, towards the thermal frame of the apparatus.

Figure 4:
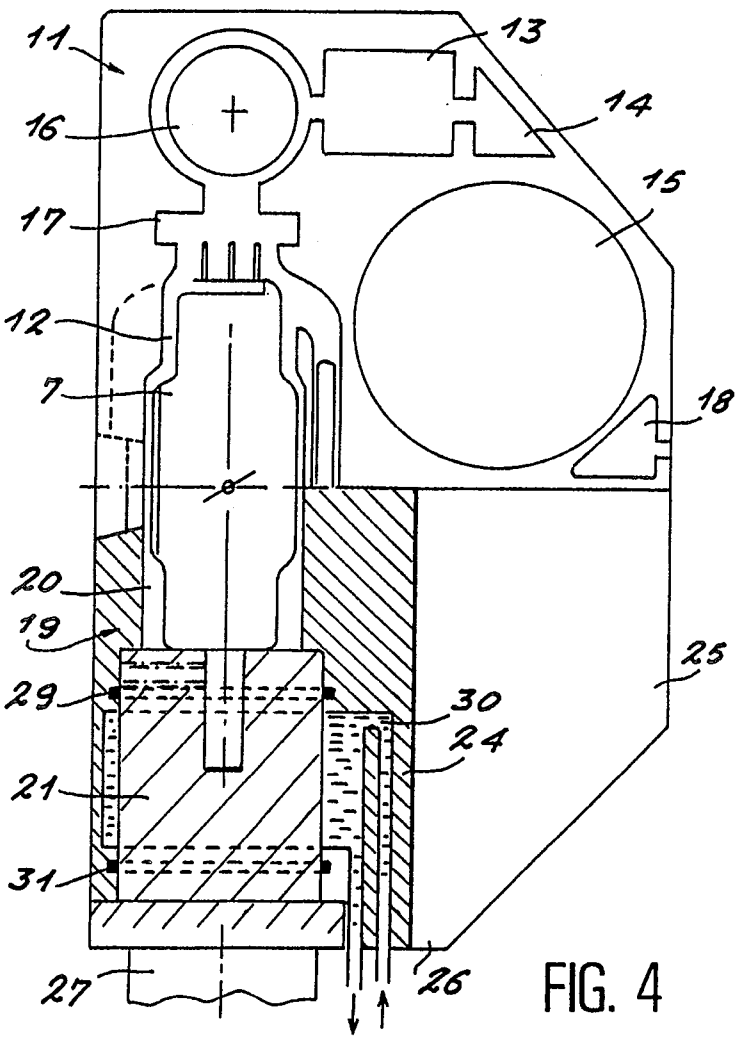
FIGS. 3 and 4 are longitudinal sectional views of a radiogenic unit according to the first embodiment of the invention, showing notably the circulation of the coolant fluids.

In FIG. 4, the supporting cylinder 21 of the X-ray tube is cooled not only by thermal conduction in the metal part 19 but also by the circulation of coolant liquid (water for example) in a circuit 30 made around the cylinder. A second O-ring seal 31 is positioned at that end of its external surface which is furthest from the tube 7 so as to limit the circulation of liquid around the cylinder 21.

FIG. 5*a* is a detailed longitudinal sectional view of the junction of the two parts 11 and 19 around the X-ray tube 7. The coolant oil circulates around the tube 7 inside the cavity 12 of the part 11 and in holes 23 made in the part 11 around the cavity 12. In these holes 23, there are embedded metal rods 22 that are arranged around the aperture of the cavity 20 of the metal part 19 and are designed to cool the oil flowing in holes 23 by thermal conduction towards the thermal frame constituted by the part 19 and the support of the radiogenic apparatus to which it is connected. The rods 22 do not penetrate to the bottom of the holes 23, just as the internal wall of said holes does not touch the part 19: this is so as to facilitate the circulation of the coolant oil throughout the length of the metal rods. FIG. 5*b* is a view along a cross-section AB of the junction of the two parts 11 and 19 around the tube 7, at the anode, showing the embedding of the metal parts 22 of the metal part 19 in the holes 23 of the insulating part 11. The coolant oil flows both around the glass wall of the X-ray tube 7 and in the holes 23 along the rods 22. FIG. 5*c* shows the same junction but along a section CD where the holes 23 are not filled by the rods 22.

Figure 6:
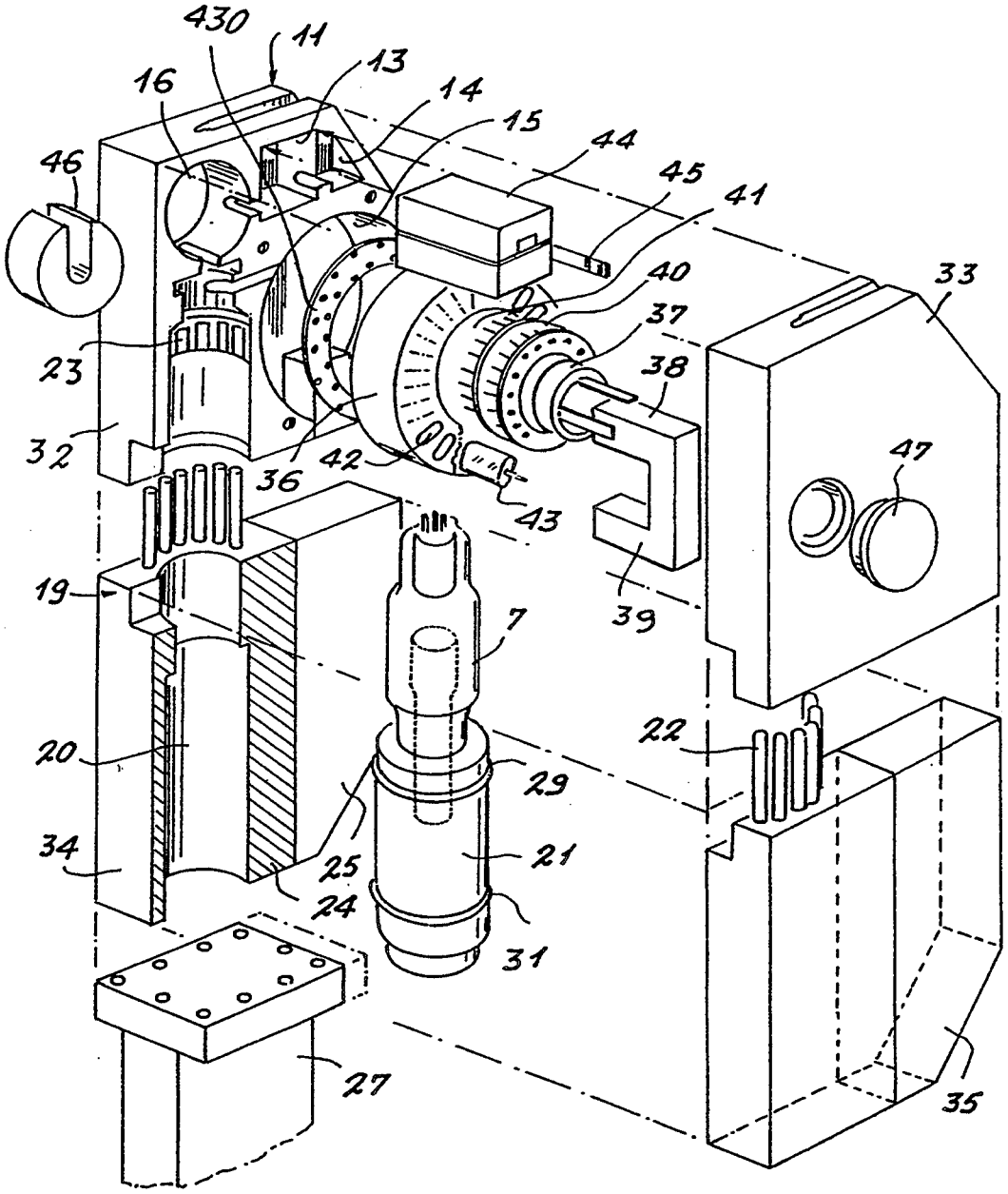
FIG. 6 is an exploded view, in cavalier projection, of the radiogenic unit according to the first embodiment of the invention.

FIG. 6 which is an exploded view, in cavalier projection, of the radiogenic unit according to the invention, shows an embodiment that is a particular embodiment since each part is formed by two shells, thus making it easier to mount the different elements of the high-voltage supply circuit in the unit. The insulating first part 11 is formed by two shells 32 and 33, made of molded plastic and secured to each other imperviously by a seal. The second metal part 19 is itself also formed by two shells 34 and 35, each comprising a solid part and a hollow part placed in a position where they face each other so as to constitute respectively the solid part 24 and the hollow part 25 of the part 19.

In the two insulating shells 32 and 33, the elements of the supply circuit are housed: in the central part of a shell 36, there is housed the primary winding 37 as well as a branch 38 of the magnetic circuit of the high-voltage transformer 39; the secondary winding 40 is housed in an annular compartment 41 located around the central part of said shell 36, which furthermore comprises annular compartments 42 at its periphery to house the capacitors 43 of the filtering circuit; the rectifier diodes are placed on a ring 430. This first element of the supply circuit of the X-ray tube is placed in the cavity 15. A measurement resistor 44 is housed in the cavity 13, a protection resistor is housed in the cavity 14 and a heating transformer 46 is housed in the cavity 16. An inspection hole 47 is drilled in one of the two insulating shells in order to enable checking of the electrical connections with the tube.

The two metal shells 34 and 35 house the X-ray tube 7 and the metal cylinder 21 that supports it. These two shells 34 and 35 are each provided with metal rods 22 that get embedded in the two insulating shells 32 and 33. Once they are joined together, these two shells 34 and 35 are fixed to the support 27 of the radiogenic unit.

Figure 7:
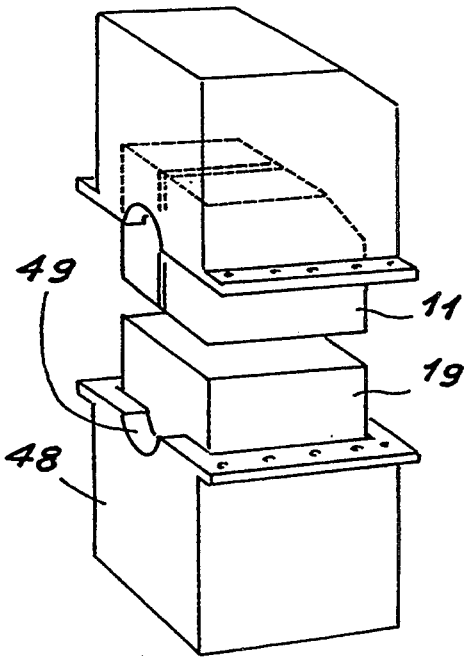
FIGS. 7 and 8 are views in perspective of two embodiments of the external casing of the radiogenic unit according to the invention.
Figure 8:
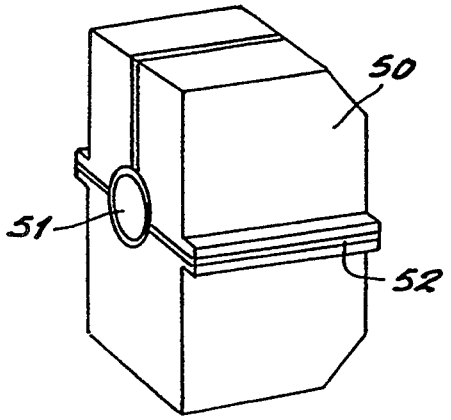

FIG. 7 shows a view in cavalier projection of the entire radiogenic unit according to the invention. The two parts, namely the insulating part 11 and the metal part 19, are enclosed in a metal cover casing 48 that is imperviously sealed against fluids and X-rays. This cover 48 is made of metal that is leaded for example so that it does not let out the X-rays emitted by the tube, except through a window 49. For reasons of easy assembling, the cover is made of two parts that are fixedly joined to each other. According to another embodiment (FIG. 8), the two parts 11 and 19 are themselves covered with a layer 50 of leaded metal, except at a window 51 for the exit of the X-rays, and are hermetically sealed by a seal 52. According to another embodiment, the two parts 11 and 19 are joined together by a seal and are placed within a plastic cover, the internal faces of which are covered with a layer of lead.

Figure 9:
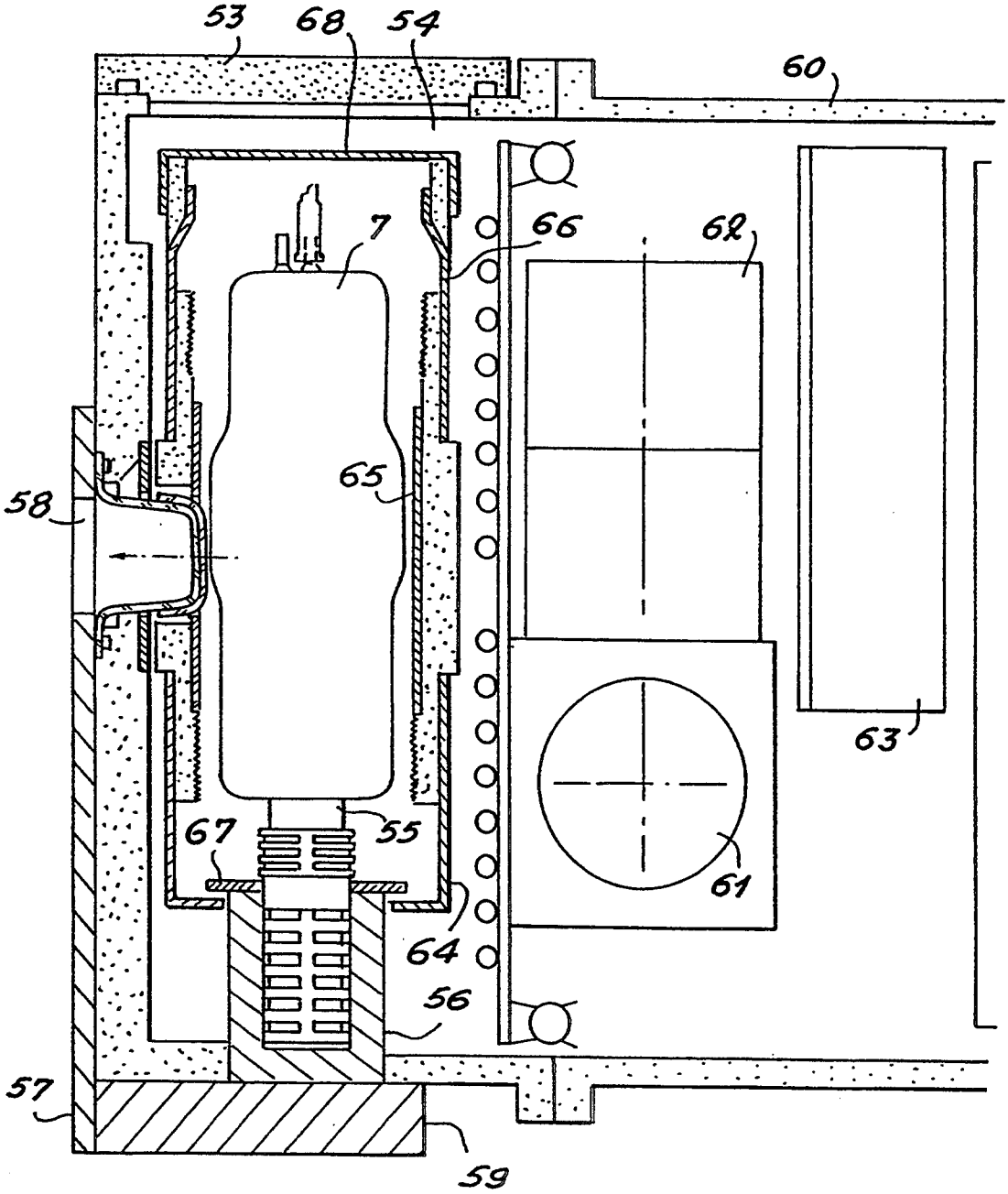
FIG. 9 is a longitudinal sectional view of a second embodiment of a radiogenic unit according to the invention.

In the embodiment of the radiogenic unit shown in FIG. 9, the two sealed parts are positioned differently from those of the first embodiment described here above. The first part 53, made of electrically insulating material such as dielectric plastic for example, has a large open cavity 54 in which the X-ray tube 7 is housed. The end 55 of the tube in which the anode is housed is supported by a cylinder 56 made of a material having the same thermal conductivity as the anode, for example copper, that is detachable to facilitate operations for changing the tube. This cylinder 56 is fixed to an aluminum flange 59 used as a support for the set and enabling the removal of the heat of the anode and that of the cylinder 56 by thermal conduction towards the stand bearing the radiogenic unit. The anode is connected electrically to said cylinder which is itself connected to an electrical frame. Said part 53 is covered with an aluminum plate 57 except at the position of a window 58, pierced to let through the X-rays, enabling the fixing of an X-ray collimator. The second part 60, which is also made of an electrically insulating material, comprises housing cavities 61 to 63 to house the high-voltage supply circuit for the tube and to house the heating transformer for the cathode. The shielding of the tube, in this embodiment, is laid close to the tube in order to reduce the required mass of lead. It is constituted first of all by a first cylinder 64, made of lead, that surrounds the part of the tube 7 comprising the anode and is taken to a zero potential with respect to the ground or frame, secondly by a second cylinder 65 that surrounds the central part of the tube 7, with a window letting through the X-rays, and that is carried to a potential equal for example to half of the DC supply high voltage of the tube in order to ensure better electrical insulation of the tube, and finally by a third cylinder 66, made of lead, that surrounds the part of the tube comprising the cathode and is taken to a potential equal to the supply high voltage. These three parts of the shielding, whose electrical voltages are different in order to balance the field around the X-ray tube, are electrically insulated from one another by walls of insulating plastic, polypropylene for example, in order to lengthen the electrical leakage lines and enable efficient circulation of oil around the tube. The first cylinder 64 is closed at its base 64 by a lead ring 67 placed against the copper cylinder 56 and taken to the potential of the frame. The third cylinder 66 is closed by a leaden lid 68 which, like itself, is taken to the potential of the supply high voltage of the tube. Coolant oil flows inside the two parts 53 and 60, notably around the X-ray tube. The two parts 53 and 60 are made of dielectric plastic that is metallized on the exterior.

The radiogenic unit according to the invention has a large number of major advantages, such as the insulation of the voltage of the cathode with respect to the frame in a volume that is smaller than in the prior art and the possibility of placing the heating transformer and the high-voltage transformer together with the rectifier and filter circuits as close as possible to the cathode of the tube to avoid the use of cables and electrical connectors. Through the speedy removal of heat from the anode in direct contact with thermal frame connected to the mounting of the apparatus, the external casing of the radiogenic unit remains cold, thus making it possible to increase its mean power. The making of the unit with two molded parts makes it possible to obtain a highly compact unit, with a reduced volume and weight, that is simple to assemble and has a low cost.

What is claimed is:

1. A radiogenic unit comprising an X-ray tube with a high-voltage supply circuit in a single-pole mode, wherein said unit comprises first and second parts which are imperviously sealed against fluids and X-rays and which are hermetically secured to each other;

wherein said first part is made of an electrically insulating material and includes a first open cavity in which a first part of the x-ray tube containing a cathode operated at a high negative potential is housed;

housing cavities for elements of the high-voltage supply circuit;

a housing cavity for a heating transformer of the cathode; and channels for circulating coolant fluid for the tube;

wherein said second part is made of metal with high thermal conductivity and includes an open cavity, in which a second part of the X-ray tube is housed, wherein the second part of the X-ray tube contains an anode and is detachably enclosed in a cylinder.

2. A radiogenic unit according to claim 1, wherein said two parts are enclosed by a protective casing, imperviously sealed against fluids and made of leaded metal in order to be imperviously sealed against X-rays, comprising a window for the passage of the X-rays emitted by the tube.

3. A radiogenic unit according to claim 1, wherein the external surfaces of said two parts are covered with a layer of lead, except at a window for the passage of X-rays, and wherein said two parts are imperviously joined together by a seal.

4. A radiogenic unit according to claim 1, wherein said two parts are joined together by a seal and placed within a plastic cover, the internal faces of which are covered with a layer of lead.

5. A radiogenic unit according to claim 1, wherein said first part is made of molded dielectric plastic having the same dielectric constant as the coolant fluid circulating in the channels.

6. A radiogenic unit according to claim 1, wherein said first part further comprises a cavity housing a volume of expansion for the coolant fluid.

7. A radiogenic unit according to claim 1, wherein said second part has a solid part recessed by the cavity for housing the X-ray tube and the supporting cylinder, and a hollow part in which a high-frequency converter is housed, the low-voltage DC supply current arriving by an aperture made in the hollow part.

8. A radiogenic unit according to claim 7, wherein said second part is fixedly joined mechanically and thermally to a support of the radiogenic unit in a radiography apparatus.

9. A radiogenic unit according to claim 7, wherein said second part is cooled by a fluid circulating in a circuit made around said cylinder.

10. A radiogenic unit according to claim 7, wherein said second part is provided with metal rods positioned around the aperture of its cavity and being inserted into holes positioned around said first cavity of said first part, in which the coolant fluid circulates.

11. A radiogenic unit according to claim 7 wherein said cylinder supporting the X-ray tube has two O-ring seals positioned at the two ends of the external surface of the cylinder.

12. A radiogenic unit according to claim 1, wherein said first part is constituted by two shells fixedly joined in an impervious manner by a seal, one of these shells being pierced with an inspection hole for the checking of the electrical connections of the X-ray tube.

13. A radiogenic unit according to claim 12 wherein said second metal part is made from two shells, fixedly joined to each other, each comprising a solid part that is recessed to form the X-ray tube housing cavity and a hollow part used as a housing for said high-frequency converter.

* * * * *